United States Patent [19]

Kemper

[11] Patent Number: 4,893,449

[45] Date of Patent: Jan. 16, 1990

[54] REMOVABLE BRIDGE PROFILE FOR FLOOR JOINTS

[76] Inventor: Hans A. Kemper, D-5883 Kierspe 1, Wehestrasse 19, Fed. Rep. of Germany

[21] Appl. No.: 285,083

[22] Filed: Dec. 16, 1988

[30] Foreign Application Priority Data

Dec. 23, 1987 [DE] Fed. Rep. of Germany ..... 3743895

[51] Int. Cl.[4] ..... E04F 15/14

[52] U.S. Cl. ..... 52/464; 52/287; 52/467; 52/716; 52/391

[58] Field of Search ..... 52/467, 718, 716, 288, 52/287, 222, 235, 273, 827, 390, 391, 464; 16/7, 16, 4, 8; 404/40, 35

[56] References Cited

U.S. PATENT DOCUMENTS

| | | | |
|---|---|---|---|
| 2,449,904 | 9/1948 | Lorraine | 16/7 |
| 2,996,751 | 8/1961 | Roby | 16/16 |
| 3,254,361 | 6/1966 | Brown | 16/16 |
| 3,266,207 | 8/1966 | Birum | 52/235 |
| 3,404,495 | 10/1968 | Simpson | 52/273 |
| 3,488,906 | 1/1970 | Brooks | 52/235 |
| 3,543,326 | 12/1970 | Rohrberg | 16/16 |
| 3,667,177 | 6/1972 | Biela | 52/287 |
| 3,844,086 | 10/1974 | Radtke | 52/464 |
| 3,909,994 | 10/1975 | Richter | 52/222 |

FOREIGN PATENT DOCUMENTS

| | | | |
|---|---|---|---|
| 983080 | 2/1965 | United Kingdom | 52/58 |

*Primary Examiner*—John E. Murtagh

*Attorney, Agent, or Firm*—Paul L. Sjoquist

[57] ABSTRACT

In a removable bridge profile for floor joints of parquet floors with different vertical position of the joint edges, consisting of an L-shaped base profile with a threaded drive channel projecting into the joint, at least one covering wing adjoining a center portion covering the joint and drive or Parker or sheet metal screws, at the lower side of the center portion two webs engaging over the upright portion of the threaded drive channel are attached.

9 Claims, 1 Drawing Sheet

REMOVABLE BRIDGE PROFILE FOR FLOOR JOINTS

Figure 1:
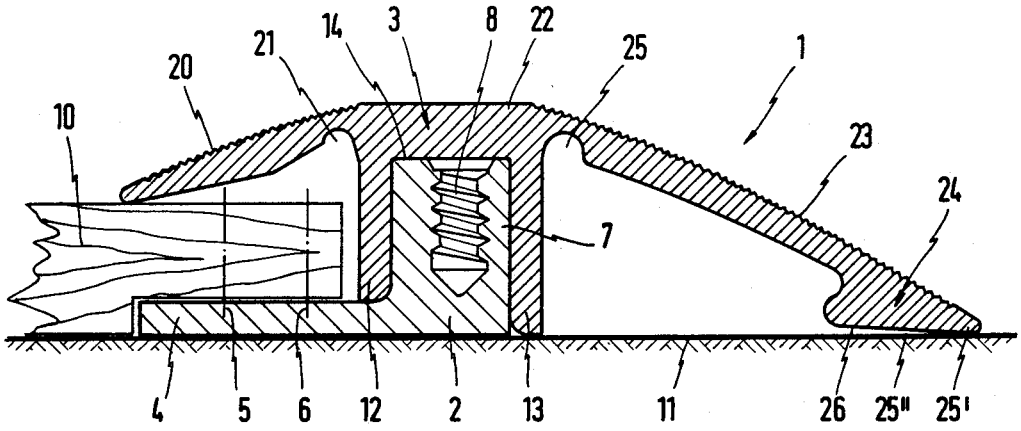

The invention relates to a removable bridge profile for floor joints, in particular for parquet floors with different vertical position of the joint edges, consisting of an L-shaped base profile with a threaded drive channel projecting into the joint, at least one covering wing adjoining a centre portion covering the joint and drive screws.

In floors, particularly however in parquet floors, especially with large areas or immediately adjoining walls, for example walls of tiled stoves, bridging profiles are necessary to take account of any expansions of the wood or the floor covering. With only slightly different vertical positions a bridge profile of the aforementioned type is employed which consists of the L-shaped base profile and a plate-shaped portion which between two covering wings comprises a centre portion in which holes are provided for the drive or metal screws. This known bridging profile does not have any constructional connections between the centre portion and the drive channel so that said profile can be used only for joint edges of approximately the same height. It has however been found in practice that with joints inter alia steps of 8–15 mm or even more can arise in that parquet floors of different thicknesses are laid and for example doorsills arise or that after wear of only part of the parquet floors and grinding thereof a different vertical level of the joint edges results.

The invention is based on the problem of providing a bridge profile of the type mentioned at the beginning with which differences in height between the joint edges of the order of magnitude of a few millimeters can be bridged without difficulty.

The problem is solved according to the invention in that at the lower side of the centre portion two webs engaging over the upright portion of the threaded drive channel are arranged.

Thus, with the solution according to the invention a guiding of the centre portion is achieved with respect to the threaded drive channel so that independently of the height difference of the joint edges screwing of the centre portion to the drive channel is possible; depending on the choice of material then by subsequent hammering adaptation of the one or both covering wings to the existing vertical position is then possible.

According to a preferred embodiment of the invention the webs are made strip-shaped and extend continuously in the joint longitudinal direction. It suffices of course for the webs to extend only in segments over partial regions. The webs are preferably of the same thickness. The webs may also have different lengths. This takes account of the fact that the base profile in known manner with its foot portion has a certain overall height.

For the bridge profile according to the invention all known materials can be used; however both parts preferably consist of aluminium.

In particular when bridging a joint at a wall or for example a tiled stove it is expedient for the profile to be able to smoothly adjoin the for example vertical wall. According to the invention for this purpose it is proposed that with provision of only one covering wing the profile comprises on the last opposite side a web-parallel closure surface.

The centre portion may be provided with countersunk holes for the drive screws, i.e. the Parker or sheet metal screws, and the covering wing/wings provided with grooves or the like extending in the joint longitudinal direction. It is also possible for the covering wings to be of different widths and for upset groups to be provided between the latter and the centre portion.

According to a further preferred embodiment of the invention at least one covering wing has a thickened support foot; the latter may have at its end region only an approximately horizontal support surface and in the region facing the centre portion have a lower surface spaced from the floor.

Figure 2:
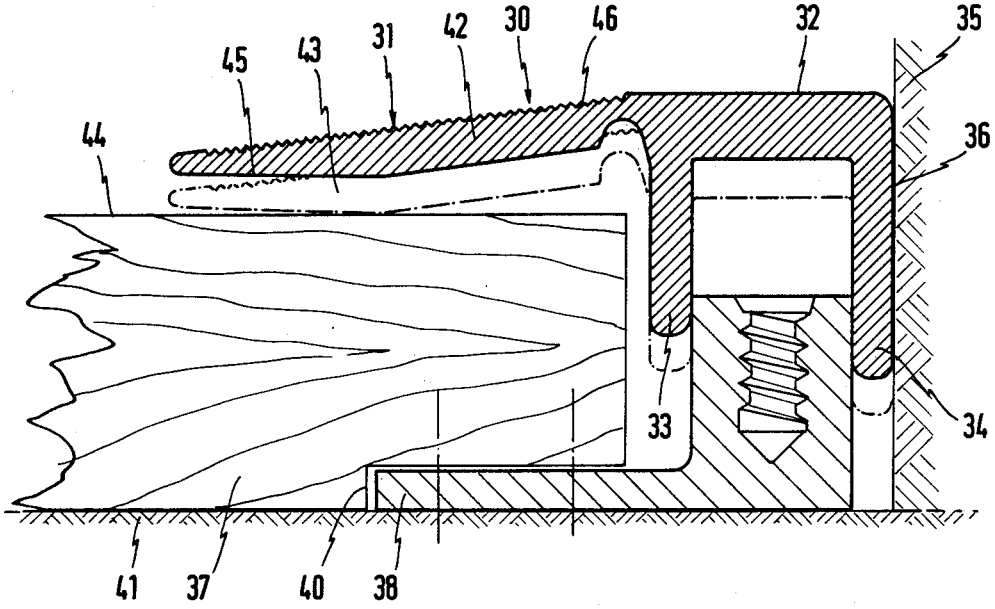

In the drawings two examples of embodiment are illustrated and will be described in detail hereinafter. In the drawings:

FIG. 1 is a cross-section to a greatly enlarged scale through one embodiment and FIG. 2 is a similar cross-section through a modified embodiment of the invention.

A removable bridge profile 1 for parquet floors consists of two parts, i.e. an L-shaped base part 2 and a covering part 3.

The base part 2 formed in usual manner comprises a floor-parallel leg 4 which is connected for example by screws 5,6 to the screed and an upright portion 7 which extends in the joint longitudinal direction and comprises a threaded drive channel 8.

Like the covering portion 3 the base profile 2 is made from aluminium.

Not shown are the sheet metal screws, preferably countersunk sheet metal screws with cross-recessed heads, screwable into the threaded drive channel. The holes for receiving the countersunk sheet metal screws are not shown either.

The bridge profile is used in FIG. 1 to bridge a "gap" between a parquet floor 10, for example having a thickness of 8 mm, and a floor 11 provided with a PVC covering, the joint between the base profile and the covering profile being illustrated in the lowermost point.

The covering profile comprises strip-like webs 12, 13 which are slidably mounted on the upright portion 7 of the base profile with close tolerances so that depending on the vertical position the covering profile can assume with the lower side of the centre portion a small or greater distance from the surface 14 of the upright portion of the base profile.

Whereas the covering wing 20 mounted on the parquet floor profile has a relatively low width and is connected via an upset groove 21 to the centre portion 22, the substantially wider covering wing 23 is provided with a support foot 24; in this case as well an upset groove 25 is provided. The support foot 24 has in its end region 25' an approximately horizontal support surface 25" whilst the rearward portion 26 is rounded or extends inclined to the floor 11. The inclined portion provides the possibility of adapting the covering wing 23 to other vertical positions without the tip of the covering wing 23 being given a spacing from the support seat in such cases.

As apparent from FIG. 1 the web 12 is shorter than the web 13, i.e. it has for example a length about 2 mm less; this length corresponds to the thickness of the portion of the base profile resting on the "floor" or the screed.

The magnitude of the height differences which can be overcome is limited by the height of the upright portion 7 of the base profile. The sheet metal screws not shown, for example countersunk screws with cross-recessed heads, can be supplied in different lengths with the bridge profile so that the parquet layer can choose the necessary length of the screws.

In the embodiment illustrated in FIG. 2 the covering part 30 is provided with only one covering wing 31. At the centre portion 32 thereof strip-shaped webs 33 and 34 are again disposed. Since said bridge profile is to adjoin a tiled wall 35 of a tiled stove the second covering wing is omitted so that the outer surface 36 of the covering wing 34 bears on the tiled wall.

The parquet 37 has a thickness of 15 mm so that the foot portion 38 of the base profile can engage below a corresponding recess 40 of the parquet 37. It is obvious that instead of this recess a 2 mm thick covering layer, for example of plastic can be provided on the screed 41.

As apparent from the left part of FIG. 2 the covering wing 30 is illustrated practically at the maximum distance from the base profile 38, the hatched portions 42 lying about 1.5 mm higher than the indicated portions 43 of the covering part, i.e. this shows that the covering part can be lowered about 1.5 mm onto the surface 44 of the parquet.

The screw connection of the covering part to the base profile has also been omitted in this case.

The covering wing 31 in this embodiment is substantially longer than the corresponding covering wing 20 and also has an approximately horizontal support surface 45. The covering wings, as shown, are provided with longitudinal grooves or longitudinal ribs 46 which extend in the joint longitudinal direction.

I claim:

1. Removable bridge profile for floor joints, in particular of parquet floors with different vertical position of the joint edges, consisting of an L-shaped base profile with a threaded drive channel projecting into the joint, at least one covering wing adjoining a center portion covering the joint and drive screws, wherein the improvement comprises a drive channel having a pair of vertical upstanding walls with planar outer vertical surfaces to form a vertical leg of said L-shaped base profile, and the lower side of the center portion comprises two parallel webs engaging over the planar outer vertical surfaces of the threaded drive channel.

2. Bridge profile according to claim 1, wherein the webs are made strip-like and extend continuously in the joint longitudinal direction.

3. Bridge profile according to claim 2, wherein the webs are of equal thickness.

4. Bridge profile according to claim 1, wherein the webs have a different length.

5. Bridge profile according to claim 1, wherein the two parts consist of aluminum.

6. Bridge profile according to claim 1, wherein the center portion is provided with countersunk holes to accept drive screws and the at least one covering wing is provided with grooves or the like extending in the joint longitudinal direction.

7. Bridge profile according to claim 6, wherein the at least one covering wing comprises two wings of different width and that between the two wings and the center portion upset grooves are provided.

8. Bridge profile according to claim 7, wherein at least one covering wing has a thickened support foot.

9. Bridge profile according to claim 8, wherein the support foot comprises an approximately horizontal support surface only at its end region and in the region facing the center portion the support surface has a lower surface spaced from the floor.

* * * * *